US006837800B2

(12) United States Patent
Rollinson et al.

(10) Patent No.: US 6,837,800 B2
(45) Date of Patent: Jan. 4, 2005

(54) GOLF CLUB

(76) Inventors: Eric A. Rollinson, 16 First Avenue, Bridlington East Yorkshire, YO15 2JP (GB); Simon T. Rollinson, 16 First Avenue, Bridlington East Yorkshire, YO15 2JP (GB)

( * ) Notice: Subject to any disclaimer, the term of this patent is extended or adjusted under 35 U.S.C. 154(b) by 0 days.

(21) Appl. No.: 10/248,816

(22) Filed: Feb. 21, 2003

(65) Prior Publication Data

US 2004/0166951 A1 Aug. 26, 2004

(30) Foreign Application Priority Data

Feb. 22, 2003 (GB) ..... 0204169

(51) Int. Cl.[7] ..... A63B 69/36
(52) U.S. Cl. ..... 473/244; 473/245; 473/296
(58) Field of Search ..... 473/245, 246, 473/247, 248, 296, 325, 244; 403/91–103; 81/58–63.2

(56) References Cited

U.S. PATENT DOCUMENTS 1,137,457 A * 4/1915 Breitenbaugh ..... 473/245
1,697,846 A * 1/1929 Anderson ..... 473/246
2,214,079 A * 9/1940 Horton ..... 473/245
2,477,438 A * 7/1949 Brouwer ..... 473/245
2,882,053 A * 4/1959 Lorthiois ..... 473/245
3,811,455 A * 5/1974 Thur ..... 135/25.4
3,840,231 A * 10/1974 Moore ..... 473/245
4,674,747 A * 6/1987 Mazzocco et al. ..... 473/296
4,735,414 A * 4/1988 Williams et al. ..... 473/248
4,878,666 A * 11/1989 Hosoda ..... 473/247
5,083,779 A * 1/1992 Ungermann ..... 473/239
5,133,553 A 7/1992 Divnick
5,538,245 A * 7/1996 Moore ..... 473/239
5,928,087 A * 7/1999 Emberton et al. ..... 473/245
6,506,126 B1 * 1/2003 Goodman ..... 473/245

* cited by examiner

*Primary Examiner*—Sebastiano Passaniti
(74) *Attorney, Agent, or Firm*—Ronald E. Smith; Smith & Hopen, P.A.

(57) ABSTRACT

The invention relates to a golf club which has a shaft and a head end with a blade for contact with a golf ball. The blade end is provided to be angularly adjustable with respect to the shaft to allow the blade to be positioned so as to provide a plurality of selectable iron and/or putter positions. The shaft can also be moved to a retracted position. The adjustment means are unobtrusive and provided between the shaft and the blade thereby not affecting the performance of the club. Thus a similar hitting potential and variation in club performance can be achieved by the single golf club as is achieved by a conventional full set of golf irons and provides an inexpensive option for players and the ability to transport the golf club as the golf club is lighter and less bulky than a full set of golf irons.

16 Claims, 10 Drawing Sheets

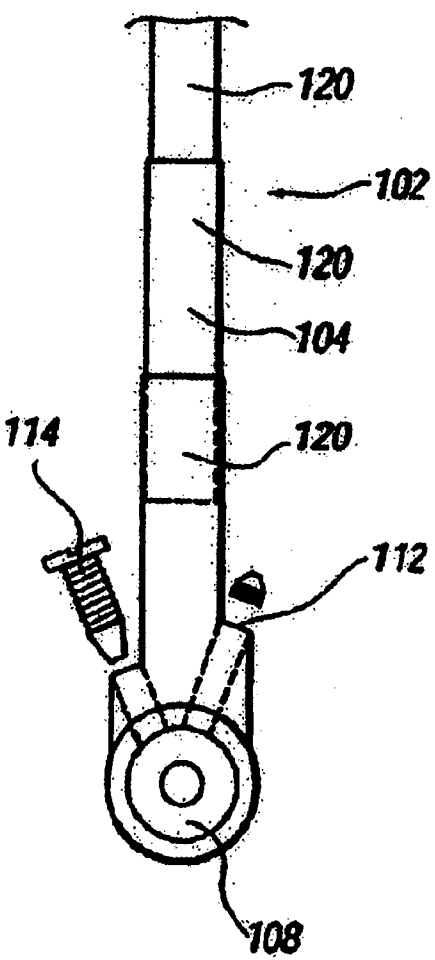
FIG. 3B
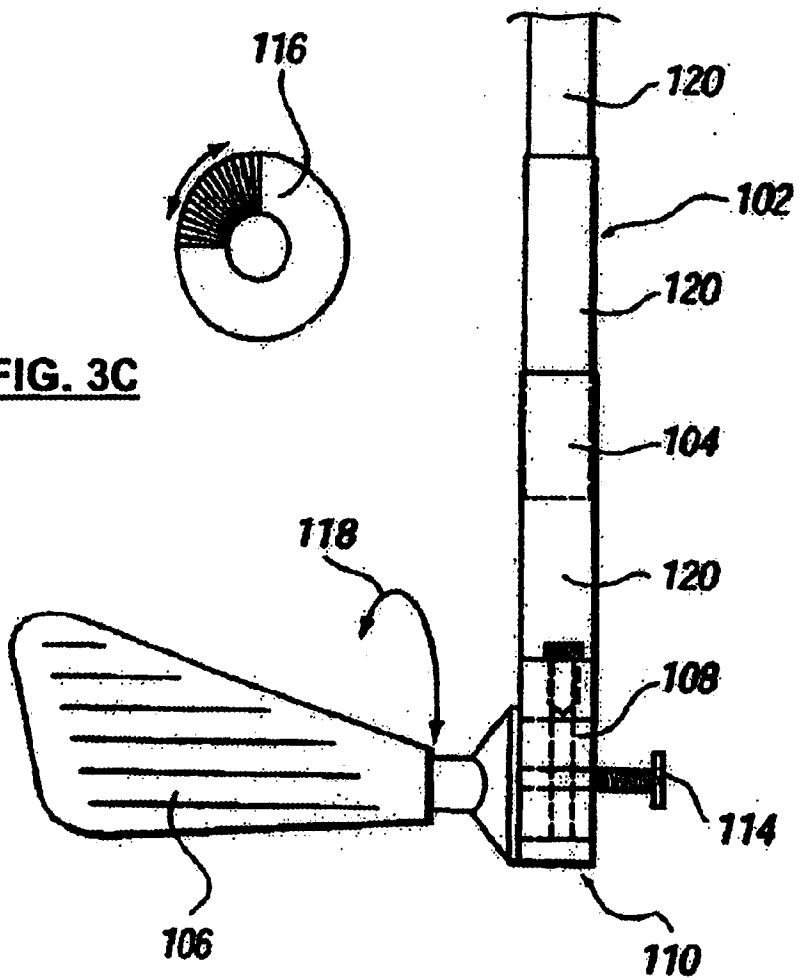
FIG. 3A
FIG. 3C

GOLF CLUB

BACKGROUND OF INVENTION

1. Cross Reference to Related Disclosures

This application claims priority from British Application No. 0204169.7, filed Feb. 22, 2003.

2. Field of Invention

The invention which is the subject of this patent application relates to a golf club.

SUMMARY OF INVENTION

Conventional golf clubs, including putters, irons and woods, as they are typically known, are provided with a shaft with a handle and a head with, in the case of irons and putters, a blade at the head for striking a golf ball therewith. With respect to irons there are a plurality of different golf irons available to a golf player, each iron having the blade positioned at a given and defined angle relative to the shaft and suitable for hitting a golf ball to travel a given distance.

There are typically 10 golf irons available, each iron having the blade positioned at an angle corresponding to one of 10 possible angles. A number 1 golf iron is typically used when a player wishes to make the ball travel a long distance through progressively shorter distances with higher numbered irons to for example, a 10 iron which is typically used when a player wishes to make the ball travel only a short distance or when the club is to be used as a pitch or sand wedge for getting out of a sand pit or bunker.

A keen golf player is likely to have a set or bag of golf clubs containing anywhere between 10–20 clubs/irons which he or she carries around the golf course during a round of golf. The bags are typically very heavy and this is inconvenient, particularly to young, elderly or frail players. A typical bag of golf clubs can also be very bulky and may be difficult to transport, for example, if the golf clubs are to be taken on holiday in an aircraft the owner may have to pay an excess baggage fee or there may be insufficient space in a vehicle such as a car boot or trunk to transport them to and from the golf course. In addition, purchasing a full set of golf irons can be expensive and this may, for example, discourage new players from taking up the sport, prevent persons in third world countries from partaking in the sport and/or discourage schools from providing golfing equipment to allow youngsters to play at school.

It is known to provide golf clubs with angularly adjustable heads but the known mechanisms are in themselves difficult to operate and/or add to the bulk of the club at the head region such that the use of the club is affected adversely.

It is therefore an object of the present invention to provide a golf club of a design which can be selectively adapted in an efficient manner to provide the same hitting potential as a number of different golf irons, thereby avoiding the need for a number of separate golf clubs to be carried and also reducing the cost required to be expended by a player in partaking the game of golf.

According to a first aspect of the present invention there is provided a golf club, said golf club comprising a shaft with a handle at one end and a head with a blade located at the other end of said shaft for striking a ball therewith, said golf club provided with adjustment means enabling said blade to be moved to one or more different angled positions with respect to said shaft, said blade connected to the shaft via the adjustment means and rotatable with respect to the shaft around a pivot axis substantially perpendicular to the longitudinal axis of the shaft, said adjustment means movable between a locking position in which the blade is retained at a selected angle with respect to the shaft and an adjusting position in which the blade can be rotated with respect to the shaft to bring about angular adjustment of the same.

Typically the adjustment means include an indicator, said indicator illustrating to the user the angular adjustment being made to the blade and hence allow the user to predict and receive an indication of the particular iron value which is represented by the particular angular position of the blade.

Typically the indicator includes a series of spaced lines, each indicative of an angular blade position, equivalent to an iron value at which the blade can be positioned. In one embodiment the blade can only be locked in position when one of the lines of the indicator positioned on one of the blade or shaft between which rotation occurs is in line with a line on the other of the blade or shaft. In one embodiment the lines of the indicator radiate outwardly from a common center.

In one embodiment the adjustment means include at least one locking member in the form of a pawl. Typically the pawl is sprung biased inwardly of the adjustment means.

In one embodiment the locking position in the adjustment means is achieved via locking means which include a plurality of teeth members for selective engagement with the one or more pawls. Typically the teeth members are spaced in a circular path. In the locked position, a portion of the at least one pawl engages with one or more of the teeth members to effectively lock the adjustment means and hence the blade in that position until the locking means are subsequently released.

In one embodiment 90 teeth members are provided in spaced angular arrangement around 360 degrees to allow the blade to be moved to a plurality of angled positions, with each of the teeth representing an angled separation of four degrees.

In one embodiment the teeth of the adjustment means are provided as part of the blade, or as part of a movable part of the adjustment means or yet further as part of the shaft which receives the adjustment means therein and, in whichever embodiment, the blade is locked in position with respect to the teeth to provide the angled position.

In an alternative embodiment 45 teeth members are spaced throughout 360 degrees to allow the blade to be moved to a plurality of angled positions, each angled position separated by eight degrees and as a result the indicator lines are spaced apart 8 degrees.

It should be appreciated that although the teeth can be spaced around 360 degrees a fewer number of teeth can be provided with the required angular spacing but not provided through the 360 degrees.

In one embodiment the locking member is in the form of at least one, but typically a plurality of pawls each of which are movable towards and away from engagement with the teeth to provide the engagement of the blade as required.

In one embodiment the adjustment means include a channel and said pawl is provided with a portion protruding into said channel.

Preferably the portion of the pawl protruding into said channel is provided with a cam surface. A securing member is located in said channel and is movable to allow engagement and disengagement with the cam surface, thereby sliding said pawl between said first engagement positions with the teeth in which the blade is locked and a second unlocked position in which the angular position of the blade with respect to the shaft can be adjusted by rotation of the blade.

In one embodiment the securing member is provided with a complementary angled surface to the cam surface of the pawl.

In an alternative embodiment a ball bearing is provided in conjunction with the securing member and the cam surface of the pawl and it is the action and relative position of the ball bearing as determined by the movement of the securing member which determines the movement of the pawls.

Preferably the securing member is a threaded screw and in one embodiment an adaptor is provided to allow manipulation and movement of the securing member by the user.

Preferably the blade can be adjusted to one of 10 possible pre-determined positions and a putter position, each position corresponding to a given angle of the blade relative to the shaft and hence correspond to an equivalent conventional golf iron blade angle and putter position in which the base of the blade is utilized.

In one embodiment of the present invention the shaft of the golf club is telescopic and can be extended and locked in position for use and retracted for transporting and storing the same. In this embodiment the shaft includes at least two portions, telescopically engaged with releasable securing means which, when engaged, lock the portion in the extended embodiment. In one embodiment the securing means comprise a biased member retained on the inner shaft which when the shaft portions reach the extended position, passes through an aperture in the outer shaft portion and is biased to that position to lock the same together. In addition to the securing means, the shaft portions are tapered outwardly from the blade end towards the handle in a progressive manner and the movement of the shaft portion to the extended position causes the tapered fit to also engage the shaft portions in this position. Thus the securing means and the tapered fit ensure that the golf club shaft is securely held in the extended position.

In a preferred embodiment, the golf club in accordance with the invention includes both the telescopic shaft and the adjustable blade thereby ensuring that the golf club has a combination of desirable features, all of which improve the adaptability and portability of the club.

The golf club according to the present invention has the advantage that a similar hitting potential and variation in club performance can be achieved by the single golf club blade as is achieved by a conventional full set of golf irons. This provides an inexpensive option for newcomers to the sport, schools, players from third world countries or the like to enable the same to play golf. The invention has the further advantage in that the golf club is lighter and less bulky than a full set of golf irons and so can be easily transported and more convenient to carry for players, and particularly players who are young, elderly and/or frail. In addition the adjustment means are provided in a manner which ensures that the weight or bulk of the same does not affect the performance of the golf club and thereby improves the opportunity for the club to be successful commercially and also be approved by the sport's governing bodies.

BRIEF DESCRIPTION OF DRAWINGS

Embodiments of the present invention will now be described with reference to the accompanying Figures wherein:

FIG. 3*a* is a cross sectional view of one embodiment of the golf club head according to the present invention;

FIG. 3*b* is a view of the golf club in FIG. 3*a* with the blade removed;

FIG. 3*c* is a schematic view of an indicator disc which can be used in the embodiment of FIG. 3*a* or other embodiments herein described;

DETAILED DESCRIPTION

Figure 1A:
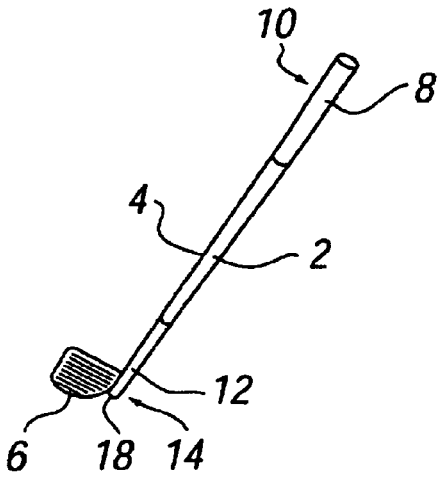
FIGS. 1*a* and 1*b* illustrate a golf club according to one embodiment of the invention in storage and in use conditions respectively.
Figure 1B:
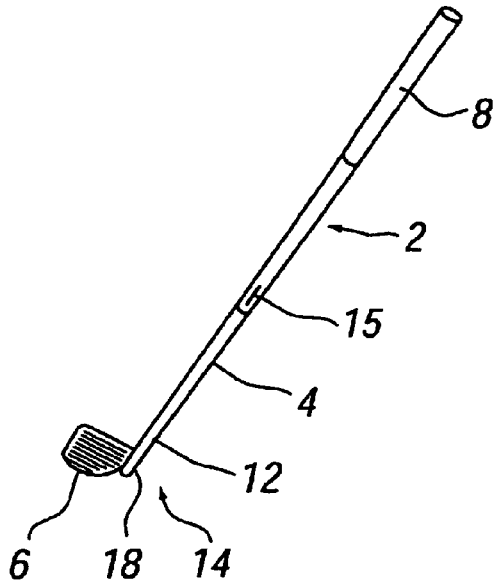

Referring to FIGS. 1*a* and 1*b*, there is illustrated a golf club 2 comprising a shaft 4 having a blade 6 at one end for striking golf balls. The shaft 4 is provided with a gripping handle 8 at a first part 10 and the blade 6 is joined to the shaft 4 via joining means 12 at which the adjustment means are provided on the second part 14. In FIG. 1*a* the club is in a storage position whereby the shaft is telescopically reduced in size as one part 14 of the two-part shaft is received within the other part, thereby reducing the length of the shaft for storage purposes. To increase the length for use, the two parts of the shaft are moved apart whereupon a combination of the engagement of the tapered shaft parts and a resilient securing member 15 which biasedly extends from the inner shaft through an aperture in the outer shaft part, serves to lock the shaft parts in the elongated position.

Figure 2:
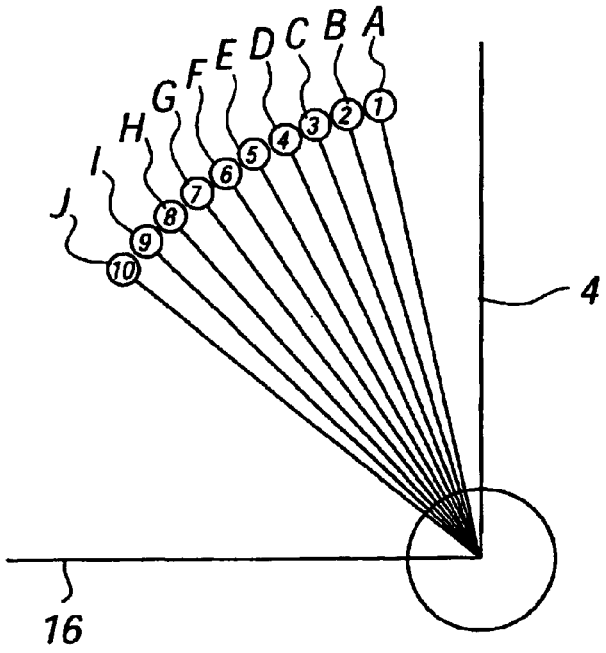
FIG. 2 is a schematic illustration of the angles through which the blade can be adjusted with respect to the shaft.

The blade 6 can be moved into a plurality of pre-determined positions, each position corresponding to a particular angle of the blade relative to the shaft 4. FIG. 2 is an example of 10 possible blade positions labeled A–J. Each position corresponds to a pre-determined angle of the blade relative to the shaft and hence corresponds to the blade angles which one would expect for conventional golf irons between 1 and 10. A putter position 16 is also available with the blade positioned substantially perpendicular to the shaft 4 such that the base of the blade is used to contact the ball.

The positions labeled A–J typically differ by 4 degrees relative to adjacent positions.

Adjustment means 18 are provided at the connection between the blade and shaft to lock the blade 6 at the required angular position to prevent the blade 6 moving during use of the golf club 2.

Referring to FIGS. 6*a*–11*b* which illustrate the preferred embodiment of the invention, there is illustrated the golf club head 302 comprising an end of the shaft 304 and a blade 306.

The blade 306 is attached to or formed integrally with holder body 308 which forms part of the adjustment means.

The holder body 308 has an arm 310 protruding from a first end 311. The arm 310 is located in an aperture in blade 306. It is noted that the blade 306 and the pawl holder body 308 can be separate units in which case the arm 310 is provided or can be integrally formed by cast molding the same in which case the arm is not required.

The holder body 308 has a channel 312 running there through and has an aperture passing from the external surface 313 of the pawl holder body into the channel 312 with one of said apertures provided for each of the pawls.

Figure 8:
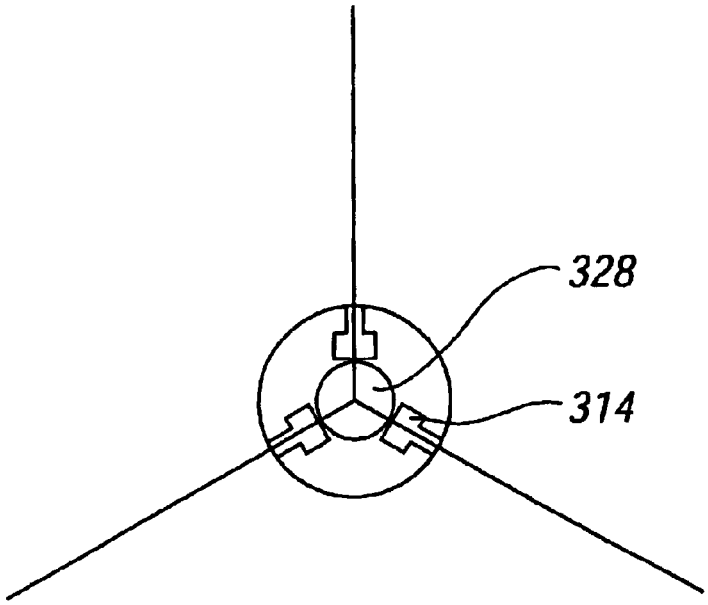
FIG. 8 is a cross sectional view taken through the pawl holder.
Figure 9:
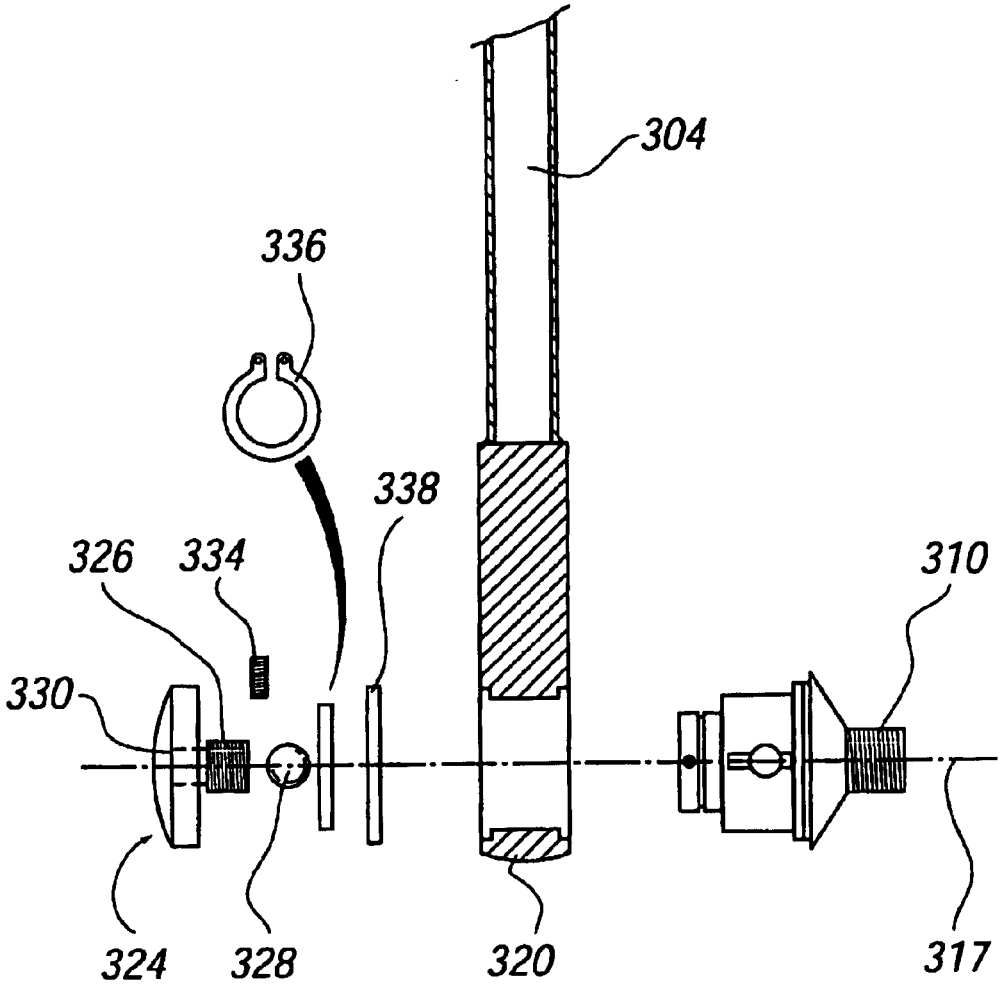
FIG. 9 is an exploded view of the adjustment means in conjunction with the shaft.
Figure 10A:
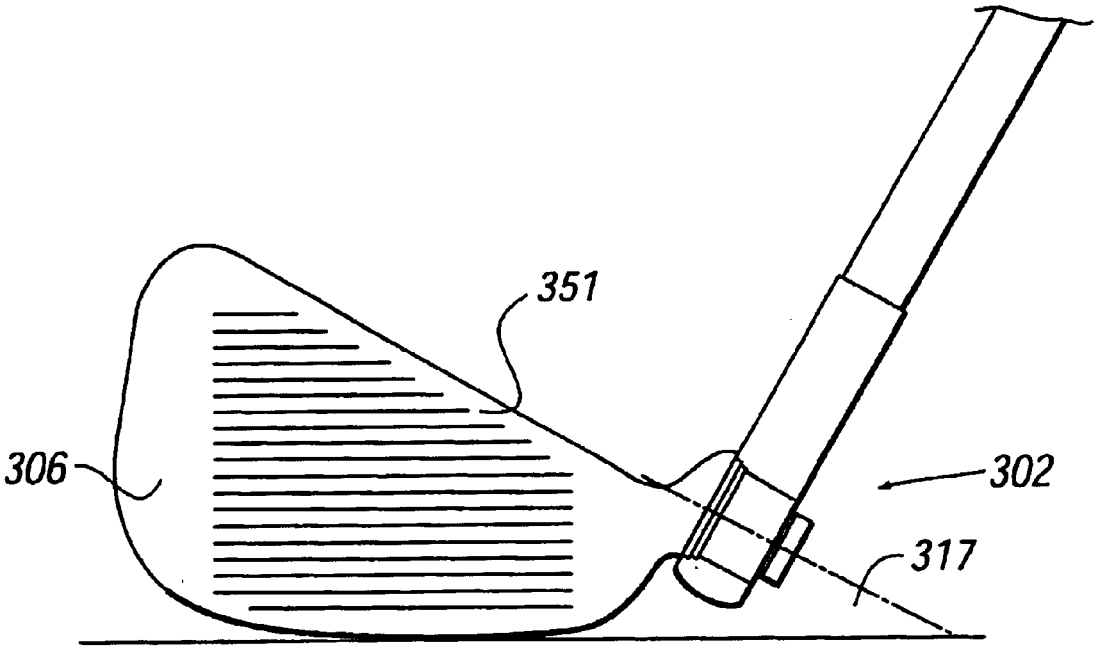
FIGS. 10*a*–11*b* illustrate views of the blade and shaft in accordance with the embodiment of FIGS. 6*a*–9.
Figure 10B:
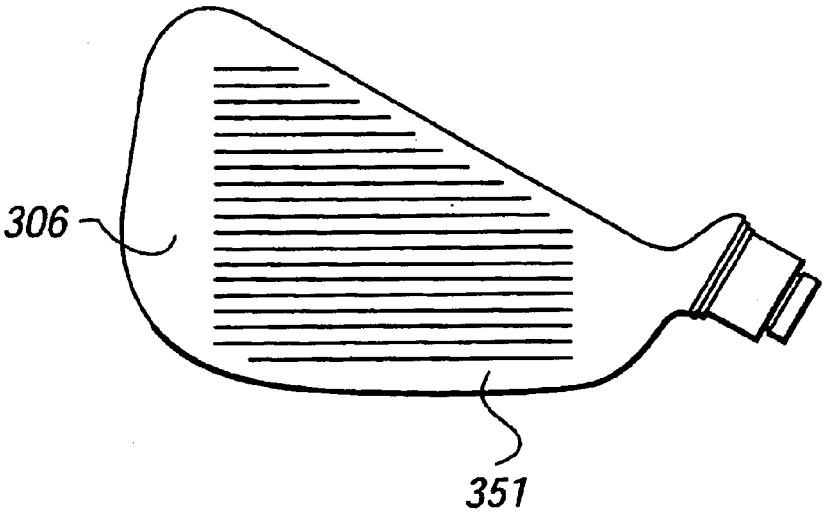
Figure 10C:
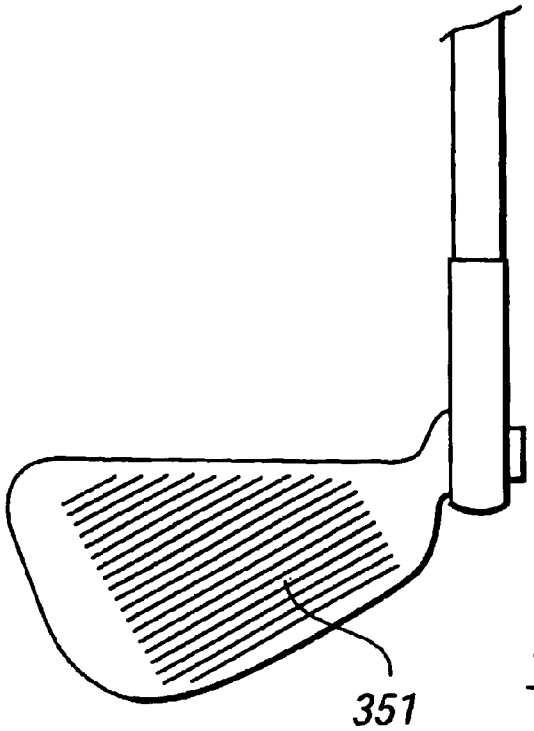
Figure 10D:
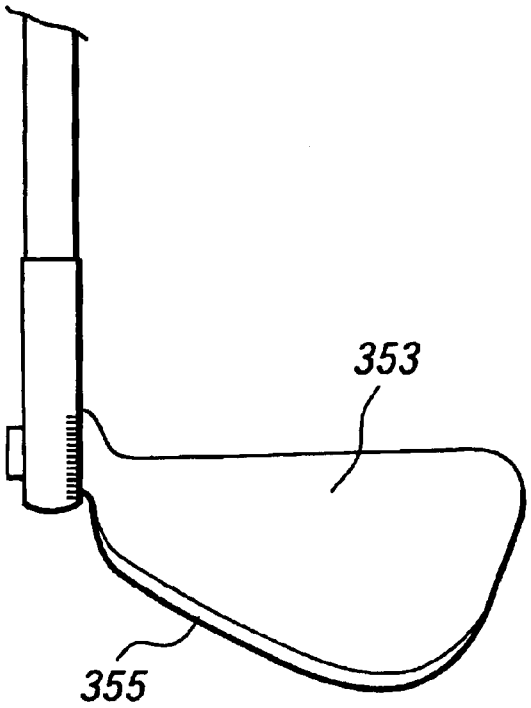
Figure 11A:
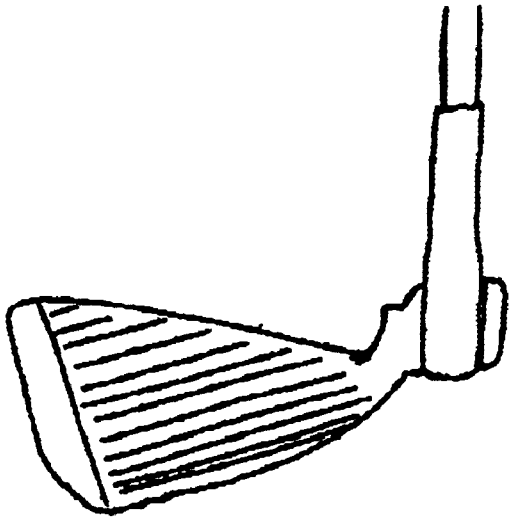
Figure 11B:
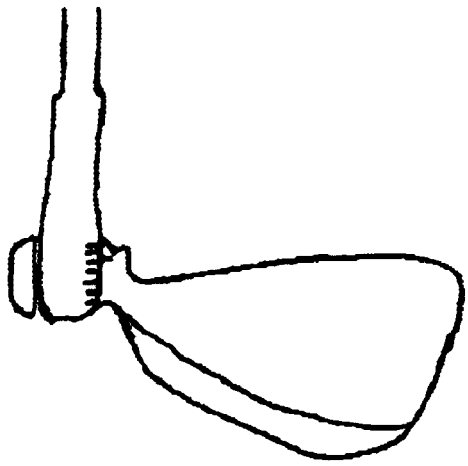

At least one pawl 314 is provided in an aperture 314 shown by dotted lines in FIG. 8. The pawl has a spring 316 acting thereon and has a cam or angled surface 318 at the end protruding into the channel 312. In the example illustrated three pawls are provided in the holder body.

In use, the outer faces 319 of the pawls lie flush with the outer surface 313 of the holder body thereby allowing rotation of the holder and hence blade with respect to the shaft housing 320 in which the holder body is located at the blade end 322 of the shaft 304. Once the blade 306 has been moved to a desired angled position by the user rotating the blade around the pivot axis 317 with respect to the shaft, a securing member 324, having a threaded end 326, in a preferred case, a left hand thread, which is located in the channel 312 is tightened, typically via an adaptor. The end 326 engages with a complementary threaded portion in the channel 312. A ball bearing 328 can be provided between the end 326 and the cam surfaces 318 of the pawls 314, such that as the end 326 and/or ball bearing contacts the cam surfaces 318 of the pawls 314, the pawls 314 move outwards of the channel 312 and allow the ball bearing to move to the engaging position and lock, with the locking screw 324, the pawls in the outwardly protruding position.

It is noted that in one embodiment the threaded end 326 of the locking screw 324 can be rounded or of a complementary angle to the cam surface, such that there is no requirement for the ball bearing.

The housing 320 in the blade typically has a plurality of teeth members 328 spaced 360 degrees around and protruding inwardly of the housing and it is towards these that the external surface 319 of each of the pawls is moved by the action of the securing member end 326. As the pawls 314 move outwards of the channel 312, the outer surface 319 of the pawl engages with the teeth members 328, thereby locking the pawl and hence the blade in that position. The pawls can be shaped accordingly to improve engagement with the teeth.

The blade angle can subsequently be adjusted by releasing the locking screw 324 which disengages the ball bearing 328 with the cam surfaces 318 of the pawls 314, thereby withdrawing the pawls 314 from the teeth members 328 and then allowing rotational movement of the blade to bring about angular adjustment with respect to the shaft.

If four degree step adjustment of the blade is required, ninety teeth members spaced around 360 degrees can be provided in the housing 320 of the shaft and this allows the blade to be adjusted to positions separated by 4 degrees. In some cases ninety teeth members may be too many to provide in the housing and so 45 teeth members can be provided, thereby providing blade positions separated by eight degrees and/or teeth may only be provided around part of the housing inner surface at the required spacing.

The locking screw 324 can be provided with a cap 330 having an adaptor or key reception groove to allow tightening and loosening of the same and a shaped interior 332 to allow it to be fitted over the end of the holder body. A grub screw or pin 334 and circlip 336 can be provided in the end of the holder body contacting the cap 330 to prevent the locking screw 314 being removed completely from the holder body. A retaining washer 338 is provided with the circlip to hold the body in a central held position. The apertures on the external surface 313 of the pawl holder body 308 can be slotted if required.

Referring to FIGS. 10*a*–11*b*, the blade is shown in detail. The blade comprises front face 351, rear face 353, and base 355. As will be seen the adjustment means between the blade and shaft are unobtrusive. When the blade is to be used as an iron the front face 351 is used to contact the ball and it is the angle of this face which can be adjusted to suit requirements as herein described. When the blade is to be used as a putter the base 355 is used and so the blade is angularly adjusted such that the blade base is positioned to be substantially in parallel with the longitudinal axis of the shaft thereby providing a substantially straight face for presentation to the ball.

Referring to FIGS. 3*a* and 3*b*, there is illustrated an alternative embodiment of a golf club 102 comprising a shaft 104 and a blade 106. Engagement means 108 are provided in an end 110 of the shaft 104 to enable the blade 106 to be moved to one or more positions. Adjustment means in the form of a threaded screw 112 is provided at the end 110 to enable a user to actuate the gear arrangement 108 and move the blade 106 accordingly.

Figure 4A:
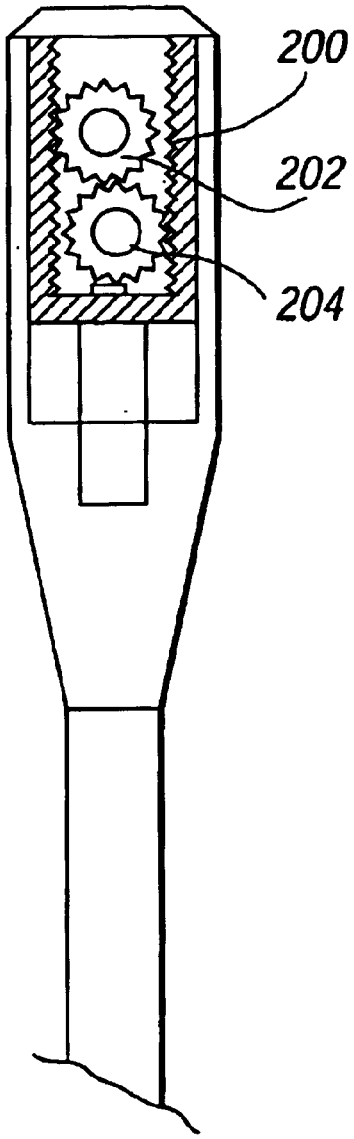
FIGS. 4*a*–4*d* illustrate various embodiments of adjustment mechanisms which may be used.
Figure 4B:
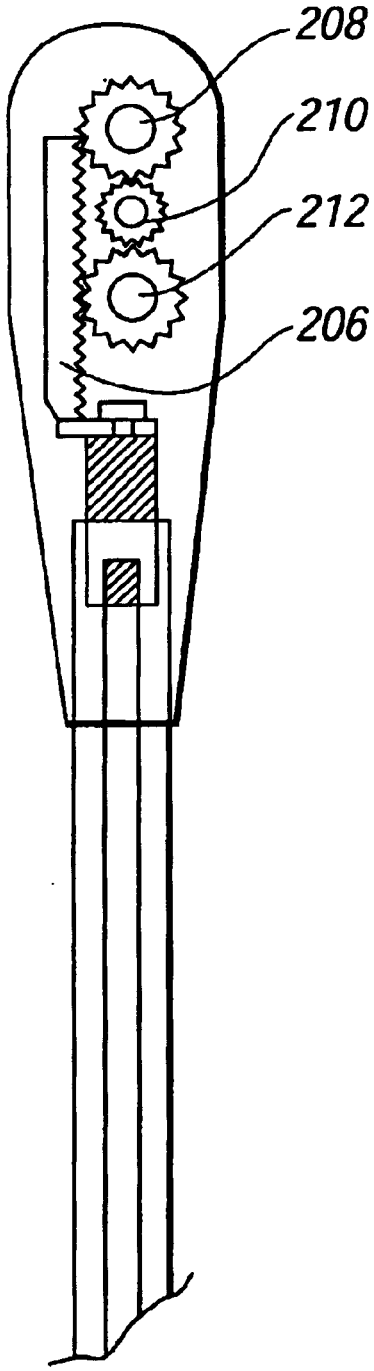
Figure 4C:
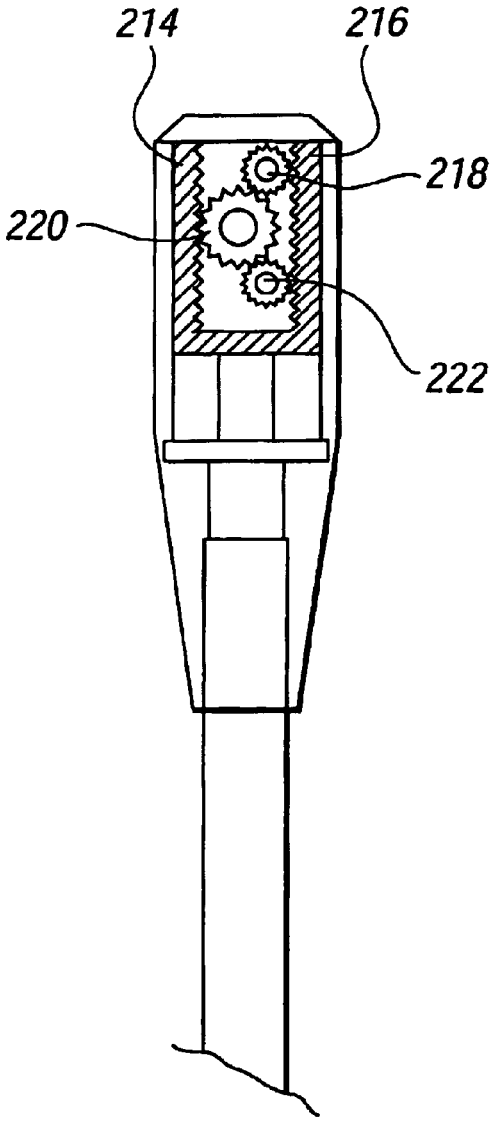
Figure 4D:
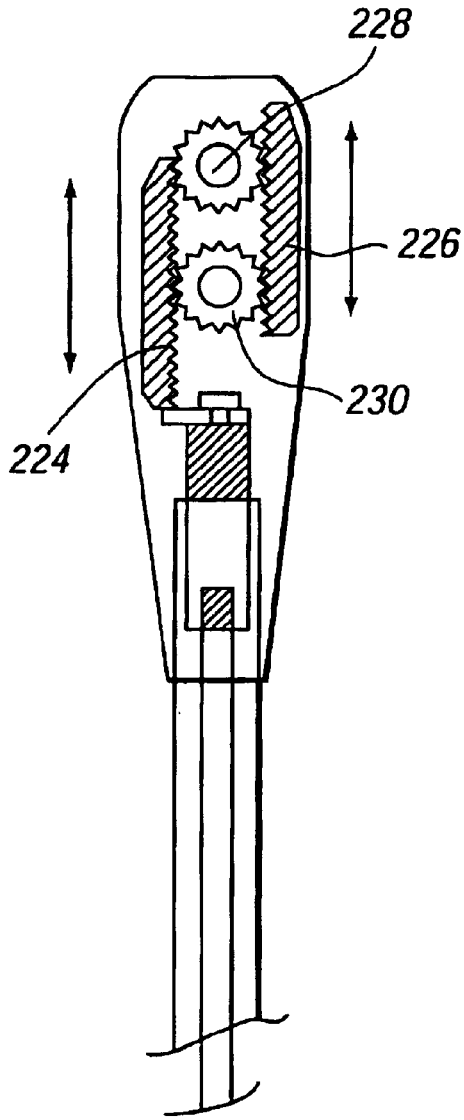
Figure 5A:
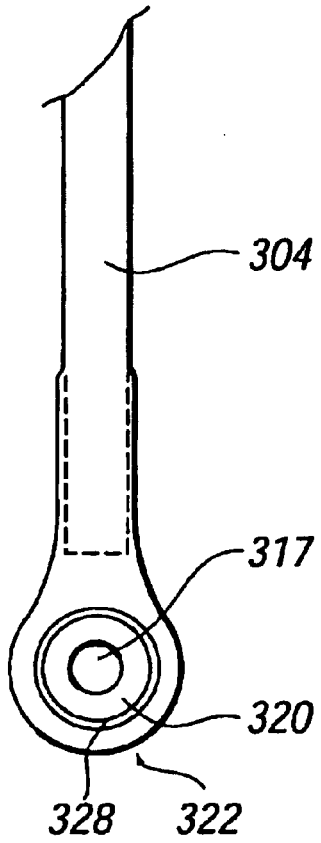
FIGS. 5*a* is a front view of part of the shaft according to a preferred embodiment of the present invention.
Figure 5B:
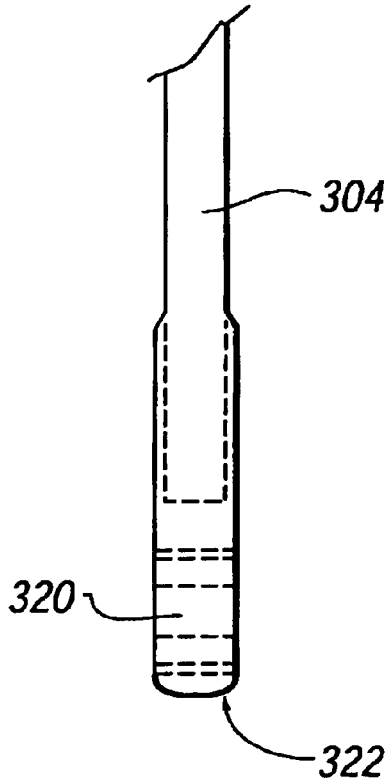
FIG. 5*b* is a side view of part of the shaft according to the embodiment shown in FIG. 5*a*.
Figure 6:
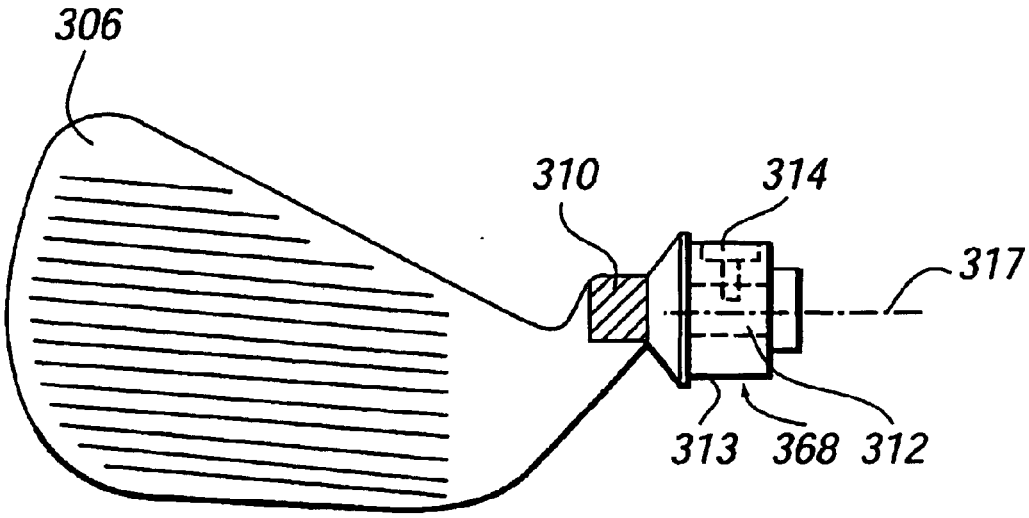
FIG. 6 is a side view of the blade of the embodiment illustrated in FIG. 5*a*.
Figure 7:
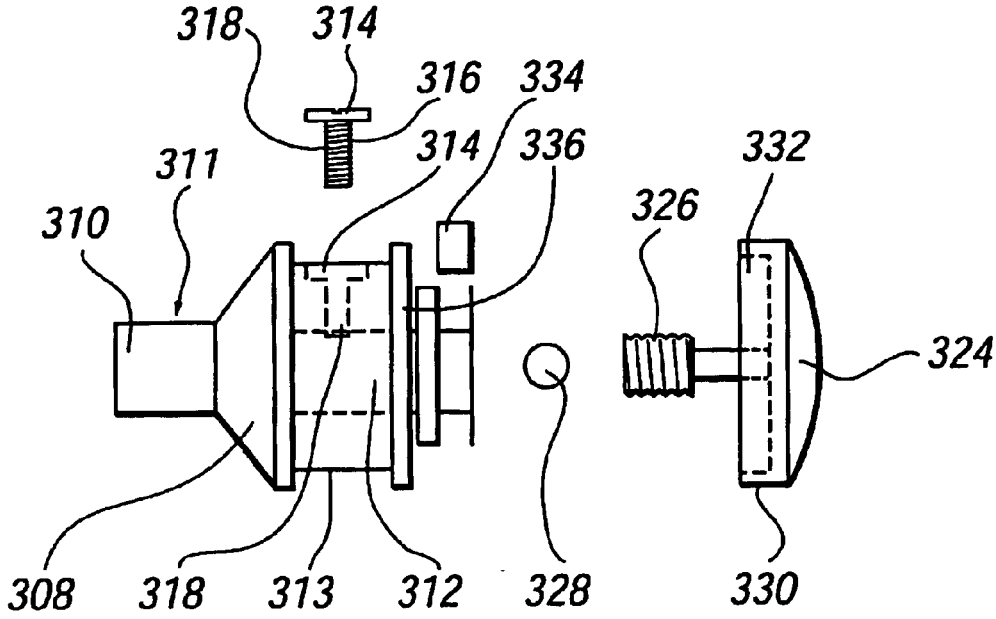
FIG. 7 is an exploded view of the adjustment means of the embodiment of FIGS. 5*a*–6.

A locking bolt 114 is provided to lock engagement means 108 in the required position during use. An angle indicator disc 116 is also provided to indicate to a user the position of the blade and/or which golf iron the position corresponds thereto. It is noted that the angle indicator disc 116 could also be rotated if required according to arrow 118 to move the blade 106 into a required position. It should be noted that the angle indicator disc 116 can be provided in any of the embodiments as herein describedReferring to FIGS. 4*a*–4*d*, there are illustrated further examples of a number of gear arrangements which can be used with a golf club according to the present invention. FIG. 4*a* illustrates a U-rack type gear arrangement comprising a U-shaped rack 200 with two interconnecting gear wheels 202 and 204. FIG. 4*b* illustrates a jockey-rack type arrangement comprising a rack 206 and three interconnecting gear wheels 208, 210 and 212. FIG. 4*c* illustrates a triple rack arrangement comprising two parallel spaced racks 214 and 216 and three interconnecting gear wheels 218, 220 and 222. FIG. 4*d* illustrates a double rack arrangement comprising two parallel spaced racks 224 and 226 and two interconnecting gear wheels 228 and 230. Worm gear arrangements or star gear arrangements can also be used.

The golf club can be cast from a metal such as stainless steel and therefore the component parts manufactured in a conventional manner.

Thus the present invention provides a golf club which can be used to produce a similar hitting potential to that of a number of different conventional golf irons, thereby eliminating the need for a golf player to purchase or transport a large number of heavy and expensive golf clubs, thus creating an opportunity for people from all economic backgrounds to be able to participate in the game of golf.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An adjustable golf club comprising:

a shaft, further comprising a distal end, a proximal end, and an aperture disposed in the distal end of the shaft;

a handle, located at the proximal end of the shaft;

an adjustable golf club head, located at the distal end of the shaft, having a blade and an adjustment mechanism, wherein the blade is connected to the shaft by the adjustment mechanism and rotatable around an axis in substantially perpendicular relation to the shaft, wherein the adjustment means further enables the blade to be moved to a plurality of angled positions, with respect to the shaft;

a housing disposed within the adjustment mechanism, adapted to lie within the aperture in the proximal end of the shaft, the housing further comprising a single set of a plurality of ratchet teeth on the inner surface thereof;

a locking mechanism extending outwardly from the adjustment mechanism to selectively engage the ratchet teeth in the housing in a pre-selected position to define the angle of the blade in relation to the shaft.

2. A golf club according to claim 1 wherein the adjustment mechanism further comprises an indicator, said indicator illustrating to the user the angular adjustment being made to the blade to allow the user to predict and receive an indication of the particular iron value which is represented by the particular angular position of the blade.

3. A golf club according to claim 2 wherein the indicator comprises a series of spaced lines, each indicative of an angular blade position, equivalent to an iron value at which the blade can be positioned and the blade can only be locked in position when one of the lines of the indicator positioned on one of the blade or shaft between which rotation occurs is in line with a line on the other of the blade or shaft.

4. A golf club according to claim 1 wherein the adjustment mechanism comprises a locking member in the form of a pawl, wherein the adjustment means is locked by the pawl engaging one of the ratchet teeth members.

5. A golf club according to claim 1 wherein 90 teeth members are provided in an inner surface of a housing in the shaft spaced around a circular path to allow the blade to be moved to a plurality of angled positions, with each of the teeth representing an angled adjustment of the blade of four degrees.

6. A golf club according to claim 1 wherein 45 teeth members are provided in an inner surface of a housing in the shaft spaced around a circular path to allow the blade to be moved to a plurality of angled positions, with each of the teeth representing an angled adjustment of the blade of eight degrees.

7. A golf club according to claim 1 wherein the adjustment mechanism includes a channel, and a pawl, wherein the pawl engages the ratchet teeth and is flush with the exterior of the adjustment mechanism when in the locked position, and where the pawl disengages the ratchet teeth and extends from the adjustment mechanism in the released position.

8. A golf club according to claim 7 wherein the portion of the pawl protruding into said channel is provided with a cam surface.

9. A golf club according to claim 1 wherein the adjustment means includes a securing member located in a channel and movable with respect to said channel to allow engagement and disengagement with the locking means and move the same between an engagement position with the teeth in which the blade is locked in position and an unlocked position in which the angular position of the blade with respect to the shalt can be adjusted by rotation of the blade.

10. A golf club according to claim 9 wherein the securing member acts on a ball bearing which contacts the locking means.

11. A golf club according to claim 9 wherein the securing member is operated by the user via an adaptor.

12. A golf club according to claim 1 wherein the blade can be selectively positioned at one of 10 possible iron positions and a putter position.

13. A golf club according to claim 12 wherein in the putter position, the base of the blade is used to contact the ball.

14. A golf club according to claim 1 wherein the shaft of the golf club is telescopic and can be extended and locked in position for use and retracted for transporting and storing the same.

15. A golf club according to claim 14 wherein the shaft includes two parts, telescopically engaged with releasable securing means which, when engaged, lock the portion in the extended position.

16. A golf club according to claim 14 wherein securing means for locking the shaft parts in the extended position comprise a biased member retained on the inner shaft which when the shaft parts reach the extended position, passes through an aperture in the outer shaft part and is biased to that position and the shaft parts are tapered outwardly from the blade end towards the handle in a progressive manner and the movement of the shaft parts to the extended position causes the tapered parts to engage the shaft parts in this position.

* * * * *